US011202964B1

(12) United States Patent
Laffin

(10) Patent No.: US 11,202,964 B1
(45) Date of Patent: Dec. 21, 2021

(54) WATER RIDE WITH EXTERNAL HEADING CONTROLLED RAFTS

(71) Applicant: DISNEY ENTERPRISES, INC., Burbank, CA (US)

(72) Inventor: Kristopher M. Laffin, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 17/073,997

(22) Filed: Oct. 19, 2020

(51) Int. Cl.
*A63G 21/18* (2006.01)
*A63G 21/12* (2006.01)
*A63G 21/08* (2006.01)
*A63G 21/04* (2006.01)

(52) U.S. Cl.
CPC ..... *A63G 21/18* (2013.01); *A63G 21/04* (2013.01); *A63G 21/08* (2013.01); *A63G 21/12* (2013.01)

(58) Field of Classification Search
CPC . A63G 3/00; A63G 3/02; A63G 21/00; A63G 21/18
USPC ..... 472/13, 117, 128–129; 441/35, 37; 104/69–70
See application file for complete search history.

(56) References Cited

U.S. PATENT DOCUMENTS 3,113,528 A * 12/1963 Morgan ..... B63H 15/00 104/73
3,404,635 A * 10/1968 Bacon ..... B63B 35/54 104/70
5,989,126 A * 11/1999 Kilbert ..... B63B 34/52 472/13

* cited by examiner

*Primary Examiner* — Kien T Nguyen
(74) *Attorney, Agent, or Firm* — Snell & Wilmer L.L.P.; Kent A. Lembke

(57) ABSTRACT

A water ride system with a flume that includes one or more sections in which a raft is unguided (except with flume sidewalls) to provide a dynamic experience with side-to-side movement and rotation. Further, the flume is configured to include one or more controlled or guided sections in which a raft is funneled or directed into a keyed guided portion of the ride path and then later released into one of uncontrolled or unguided sections of the flume. A raft includes a keyed guide assembly, mounted upon a lower surface of the raft body, that includes a pair of spaced apart guide members. In a guiding subsection of the flume, the bottom wall or lower surface of the flume includes a raised portion that includes a guideway or groove for receiving the guide assembly, whereby the raft has it directional and rotational movements guided in the flume.

20 Claims, 5 Drawing Sheets

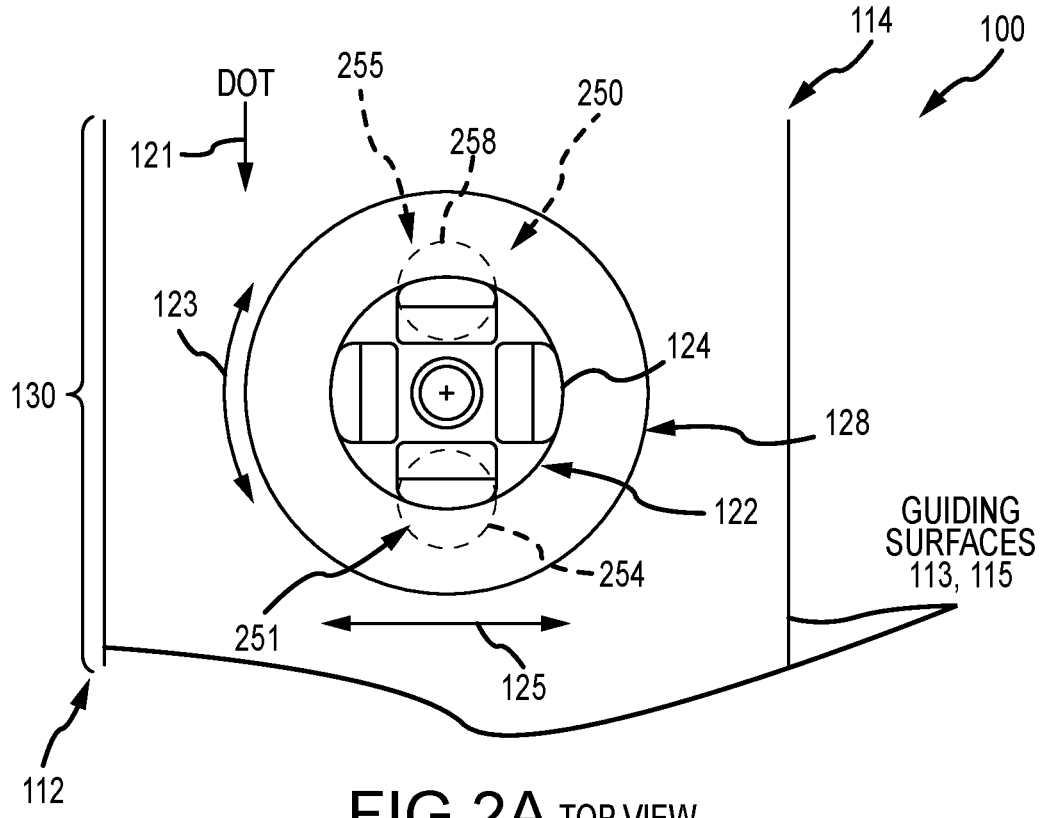
FIG.2A TOP VIEW
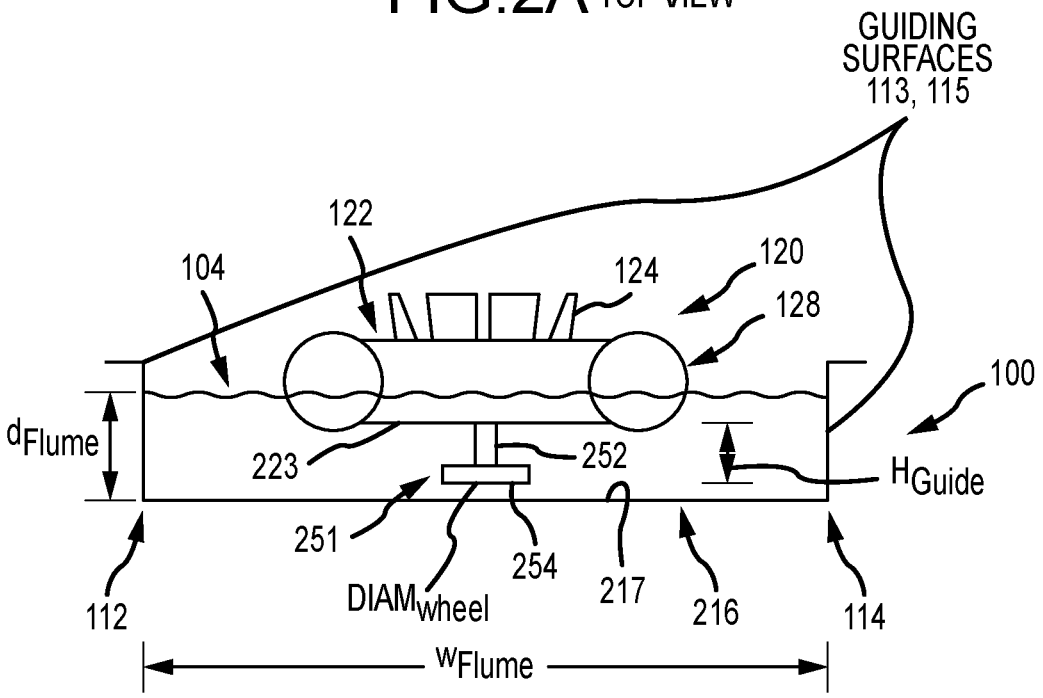
FIG.2B END VIEW

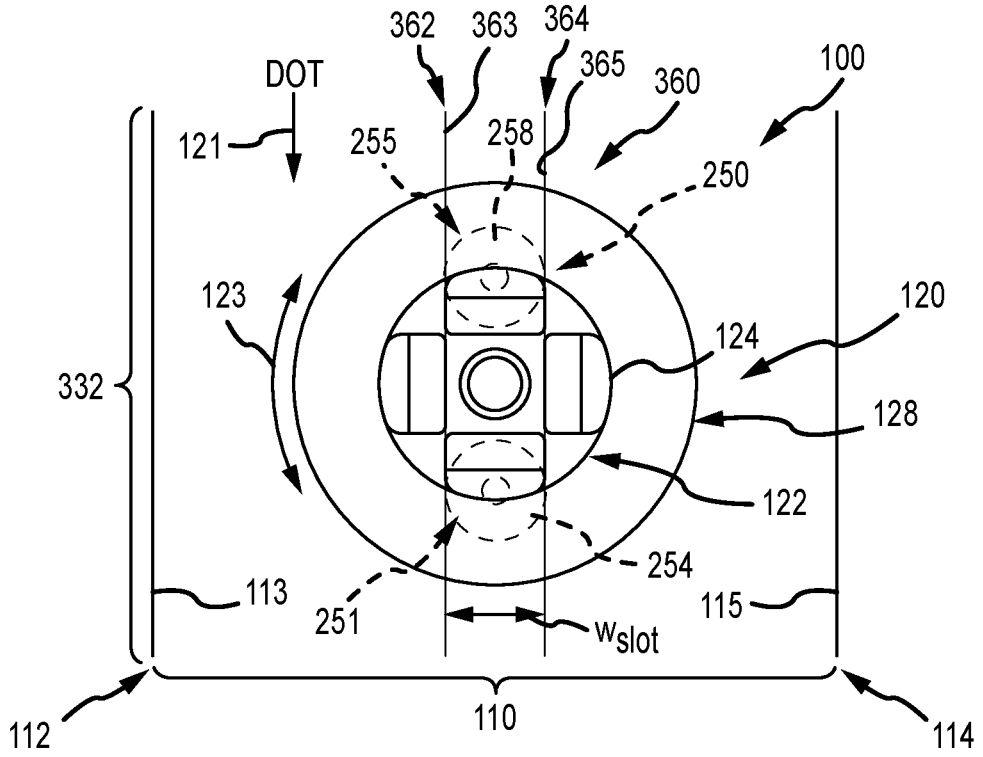
FIG.3A TOP VIEW

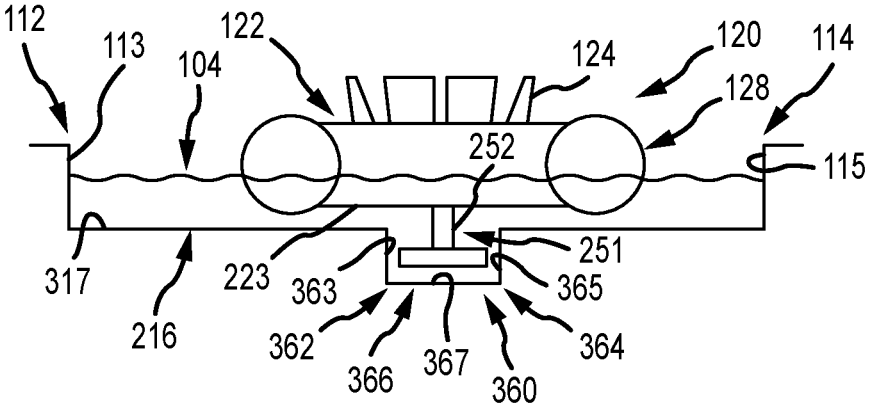
FIG.3B END VIEW
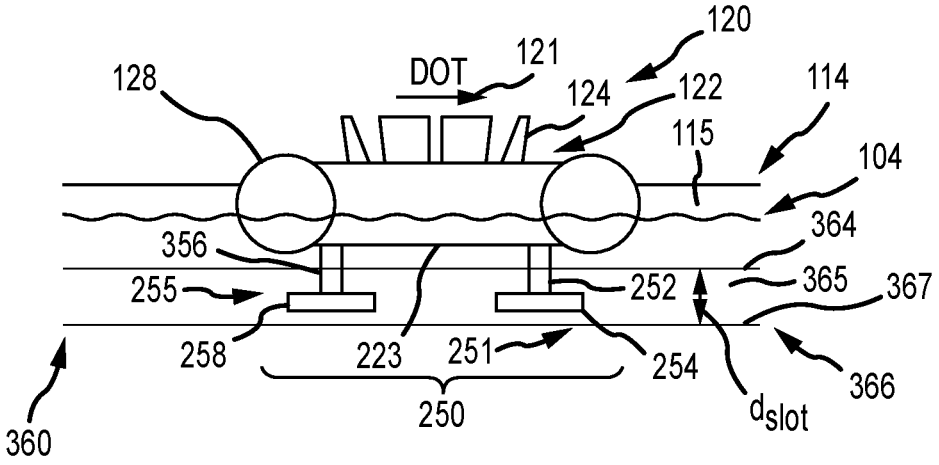
FIG.3C SIDE VIEW

WATER RIDE WITH EXTERNAL HEADING CONTROLLED RAFTS

BACKGROUND

1. Field of the Description

The present description relates, in general, to passenger boats such as round rafts and their use in water-based rides (e.g. "raft rides") in amusement parks, theme parks, and water parks, and, more particularly, to a water ride (or water ride system) adapted to provide sections in which passenger rafts are free to move and rotate within a flume and sections in which the passenger rafts are externally orientable and/or guided to control the raft's heading as they travel along a ride path in a direction of travel ("DOT").

2. Relevant Background

In amusement parks, water parks, resorts, and many other settings, entertainment is provided that involves passengers riding on boats in still and moving water. For example, resorts may provide passenger boats in the form of rafts, kayaks, and paddleboats to their guests to allow them to play in the water. In amusement parks, many rides have been designed and implemented that provide a river rafting experience that may simulate whitewater rafting.

In most raft-based rides, passengers enter a non-motorized boat, such as a round raft, in a station. Upon release from the station, water flowing, often but not exclusively under the force of gravity, in a man-made channel or flume moves the passenger boats down the channel and may even cause the boat to flow over rapids and down steep chutes. Excitement and thrill are added to these water rides by introducing the risk that passengers may get soaked with water or at least be sprayed and by simulating a wilderness river raft trip by allowing the raft to move from side-to-side across the width of the flume and to freely rotate because the raft is round.

While water rides are some of the most popular park rides, visitors to these parks are continuing to expect more variety and differing entertainment from these rides. However, current designs with free movement throughout a raft ride limits the type of experience and how show or story features can be provided along the ride path. Traditional guided-boat rides couple the boat to an underwater track along the entire length of the flume to guide the boat's travel in the flume in a predictable direction and heading and at a predefined speed throughout the ride. Although these ride designs are useful for providing a show or telling a story with show elements along the flume, the defined flume and track makes it very difficult, if not impossible, to surprise the passengers by creating a more unpredictable and dynamic ride experience.

In contrast, traditional raft-type rides provide unpredictable experiences as the passenger boats or rafts (as these terms may be used interchangeably herein) are only limited by sidewalls of the flume, which typically has a width much larger than the rafts used on the rides. As a result, the rafts are not strictly guided and can rotate in any direction. This unpredictability provides a more exciting and dynamic ride experience. However, it also frustrates ride designers because there is no way of knowing where a raft will be located relative to the sides of the flume and which way the raft will be oriented, which makes it very difficult to tell a dynamic, linear story or to use carefully positioned show elements to present show effects in a known manner to the passengers.

SUMMARY

The inventor recognized that there was a need for a water ride (or water ride system) that provided passengers of boats, rafts, and the like (with all such watercraft labeled as "a raft" or "non-motorized raft" herein) new and exciting experiences. Specifically, there was a need for a water ride system designed to allow ride designers to include more show features including an ability to tell the passengers of the rafts a story as they travel along the ride path without removing the variability and excitement that comes with raft rides. The new water ride system includes a flume with flowing water to move passenger rafts (typically, non-motorized circular rafts) along a ride path in a particular direction of travel ("DOT") and at one or more velocities.

Briefly, the flume is configured to include one or more sections in which a raft is uncontrolled or unguided (except with flume sidewalls) to provide a dynamic experience with side-to-side movement and rotation about the center axis of the raft. Further, though, the flume is configured to include one or more controlled or guided sections in which a raft is funneled or directed (e.g., in a receiving or capturing subsection of the controlled or guided section) into a keyed guided portion of the ride path (e.g., in a guiding subsection of the controlled or guided section) and then later released (e.g., in a releasing or exiting subsection of the controlled or guided section) into one of the uncontrolled or unguided sections of the flume.

Rafts include a keyed guide assembly mounted (or otherwise provide) upon a lower surface of the raft body. The keyed guide assembly may include a pair of spaced apart guide members, which may be formed of a linear or elongated guide post or axle extending downward a distance from the raft body's lower surface and a guide wheel pivotally coupled to an end of the guide post/axle. In the guiding subsection of the controlled or guided section of the flume, the bottom wall or lower surface of the flume includes a raised portion that includes a guideway or groove for receiving the guide post and the guide wheel and to guide with its two inward-facing (and, typically, vertical) sidewalls or contact surfaces, with the guide wheel at least periodically contacting or abutting these sidewalls or contact surfaces to cause the raft to be directed in the flume to follow the path defined by the guideway/groove. The use of two guide members may be desirable to block the raft from rotating and to hold a fixed orientation as the raft travels along the guiding subsection, but some embodiments may only include one guide member and allow rotation of the raft about its center axis while controlling the raft within the guideway (e.g., to fix the location of the raft across the width of the channel or flume along the guiding subsection).

More particularly, a water ride system is provided that includes a flume for receiving and containing flowing water. The flume includes first and second sidewalls spaced apart defining a width of the flume and further includes a bottom wall extending between lower edges of the first and second sidewalls. Within the flume, a raft is provided with a body with seats for one or more passengers and with a resilient and buoyant bumper extending about a periphery of the body. During system operations, the raft travels in a direction of travel (DOT) coinciding with a direction of flow of the flowing water. The water ride system also includes a guide assembly mounted on a lower surface of the body of the raft, and, during system operations, the guide assembly is at least partially submerged in the flowing water.

Further, the flume includes a first section in which the guide assembly floats above an upper surface of the bottom wall as the raft travels in the DOT with the flowing water, the raft, in the first section, being free to rotate about a central axis and to move side-to-side until the bumper contacts inward surfaces of the first and second sidewalls. Still further, the flume includes a second section including a groove in a raised portion of the upper surface of the bottom wall or a separately installed side guide system (e.g., rails or guiding surface including support structure mounted to the bottom or side of the major flume), The guide assembly being at least partially received within the groove or guide rails (or groove/slot defined by such guide rails) as the raft travels in the DOT with the flowing water in the second section, whereby the raft has side-to-side movement in the flume that is restricted by the groove sidewalls to define a ride path for the raft within the second section defined by the groove.

In some embodiments, the guide assembly includes a guide post extending outward a distance from the lower surface of the raft. In some preferred implementations, a wheel is pivotally supported upon an end of the guide post (which is or acts as an axle in some cases) distal to the lower surface of the raft. In other embodiments, though, the guide assembly further includes a second guide post extending outward from the lower surface of the raft, and the second guide post is spaced apart a distance from the guide post, whereby the raft is limited in rotation about the center axis by inner surfaces of sidewalls defining the groove. Another embodiment would be to have a single center post with two wheels mounted to the bottom at a distance from each other to also keep the raft from rotating. Then, the guide assembly further may include first and second wheels each pivotally supported upon an end one of the guide post and second guide post distal to the lower surface of the raft. The first and second wheels each may have an outer diameter that is less than a distance between the inner surfaces of the sidewalls of the groove by an amount in the range of 1 to 8 inches. In some cases, the vertical axes of the guide post and the second guide post are co-planar with the center axis of the raft.

The flume may further include a third section, between the first and second sections, comprising spaced apart sidewalls or side guides with inner surfaces for abutting at least a portion of the guide assembly during travel of the raft in the DOT with the flowing water in the third section. Then, the spaced apart sidewalls of the third section angle inward from the first and second sidewalls of the first section to an inlet of the groove, whereby the raft is guided in the flume to move at least a portion of the guide assembly into the groove of the second section. In these implementations, the spaced apart sidewalls have an upper edge that is raised above the upper surface of the bottom wall, whereby, when the raft moves side-to-side in the third section of the flume, the bumper is able to float over the inner surfaces of the spaced apart sidewalls and the guide assembly at least partially contacts the inner surfaces of the spaced apart sidewalls to guide the raft within the flume. The spaced apart sidewalls may be angled inward at an angle in the range of 15 to 45 degrees or a curvature designed to better funnel the raft into the guide channel.

BRIEF DESCRIPTION OF THE DRAWINGS

FIGS. 2A and 2B are schematic top and end views, respectively, of the water ride system of FIG. 1 showing details of the keyed guide assembly on the bottom of raft, with these views showing the section of flume where the keyed guiding system is not being used and the raft is guided using the outer tube and primary flume walls providing an unpredictable vehicle motion;

FIGS. 3A-3C are schematic top, end, and side views, respectively, of the water ride system of FIGS. 1, 2A, and 2B showing further details of the keyed guide assembly and of a controlled or guided section of the ride's flume.

DETAILED DESCRIPTION OF THE PREFERRED EMBODIMENTS

Briefly, the following description describes a water ride system with external heading controlled (or controllable or guidable) passenger rafts. In contrast, traditional raft rides have used a vehicle that is circular and contains an inflatable rubber bumper around the whole passenger compartment. This rubber bumper provides cushioning when the vehicle hits the flume wall and is used as the main way of guiding the raft down the flume. The raft in the traditional raft rides had no other way of guiding so that the raft is directionally unrestricted and can (and does) typically rotate in both a counterclockwise or clockwise direction through the course of the ride.

Figure 1:
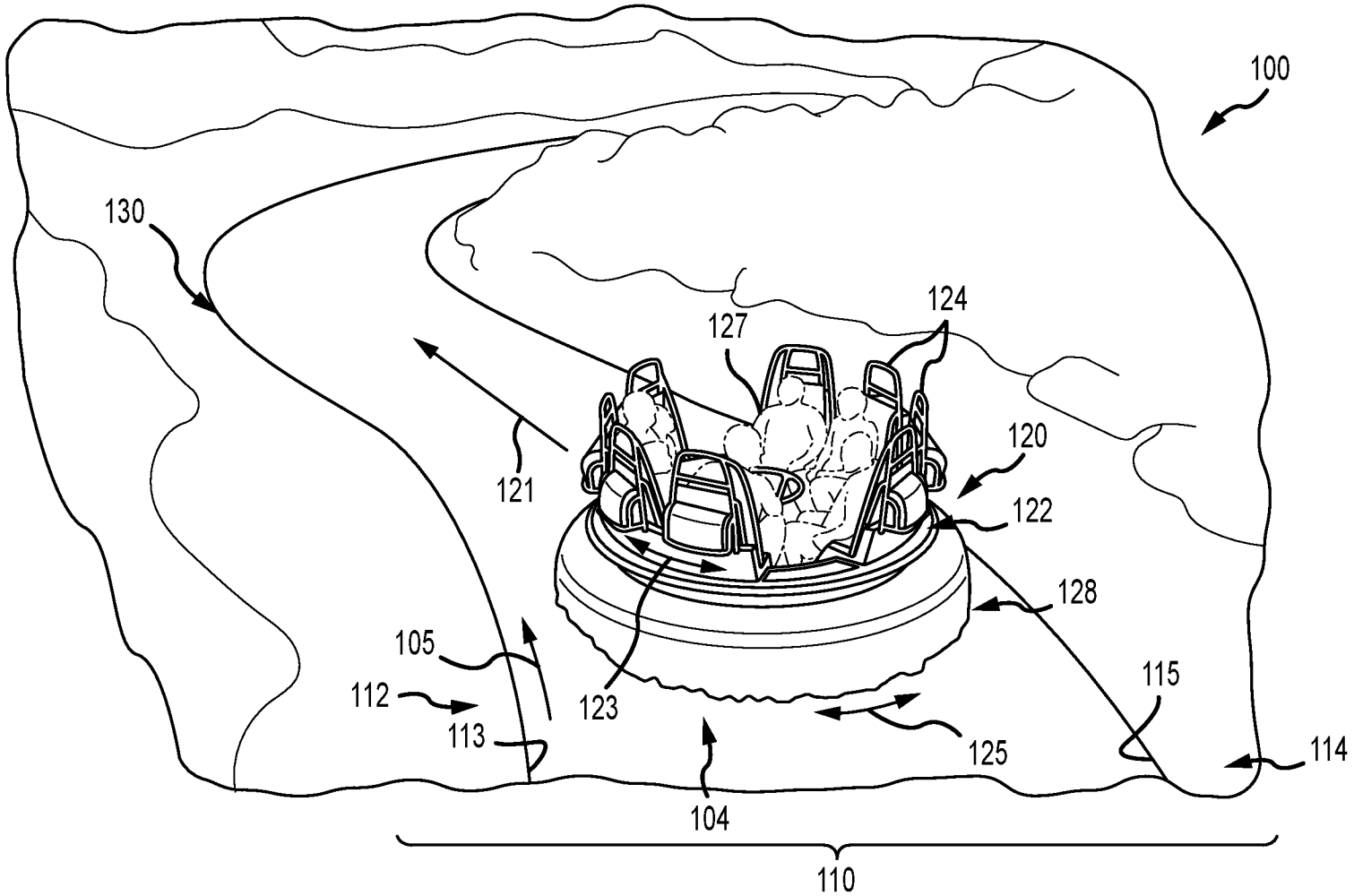
FIG. 1 is an isometric perspective view of a water ride system of the present description during its operations, with a raft with passengers traveling through an uncontrolled or unguided section of a flume.

Similarly, FIG. 1 is an isometric view of a water ride system 100 of the present description with a raft 120 with passengers 127 traveling through an open section 130 of a flume 110. The raft 120 is of a circular design with a circular-shaped body or passenger compartment 122 with seats 124 for the passengers 127 so that they face inward toward (or away from, in some cases) a center axis, $Axis_{Center}$, of the raft 120. The raft 120 further includes a bumper 128, which may be an inflatable rubber (or other flexible material) member, that extends about the whole periphery of the circular body 122.

The water ride system 100 includes a flume 110 configured to hold or receive a volume of water 104 that flows as shown with arrow 105. To this end, the flume 100 includes left and right (or first and second) sidewalls 112 and 114 for defining a path for the water 104 (and a ride path for system 100) and defining its maximum depth with vertical (or sloped) inward facing contact surfaces 113 and 115. In the uncontrolled or unguided section 130 of the flume 110 shown in FIG. 1, the raft 120 is directionally unrestricted and can move as shown with arrow 125 side-to-side across the width of the flume 110 (i.e., between contact surfaces 113 and 115 of flume sidewalls 112 and 114). Further, the raft 120 is free to rotate as shown with arrow 123 about the center axis, $Axis_{Center}$, of the raft 120.

The raft 120 moves in a direction of travel ("DOT") shown by arrow 121 in the flume 110, with the DOT 121 coinciding with the direction of flow 105 of water 104 in the flume 110 (as the raft 120 is non-motorized in many embodiments of system 100). The raft 120 is hence uncontrolled by the system 100 in this section 130 of the flume 110 except by the flow of the water 105 that carries the vehicle 120 along the flume 130. The raft 120 is only loosely guided by the configuration of the inner surfaces or sides 113, 115 of the flume sidewalls 112, 114 which may periodically contact or abut the bumper 128. Hence, the section 130 of the flume 110 is useful for providing a length (or lengths if more than one such section is included) of the ride path with an unpredictable ride experience.

FIGS. 2A and 2B are schematic top and end views, respectively, of the water ride system 100 showing details of keyed guide assembly 250 on a bottom surface (or portion) 223 of the body or passenger compartment 122 of the raft 120. The raft 120 is traveling under the force of flowing water 104 in the flume 110 in an uncontrolled or unguided section 130 of the flume 110 (or of the ride path defined by the flume 110). In this section 130, the raft 120 is allowed to freely orient and direct itself with rotation 123 about its center axis, $Axis_{Center}$, and with side-to-side movements 125 across the flume 110. The guiding or contact surfaces 113, 115 of the flume's two sidewalls 112, 114 provide the only guidance as the bumper 128 (e.g., an inflatable bladder) will contact and bounce off these surfaces when the movement 125 moves the raft 120 to the edges of the flume 110. Otherwise, the raft 120 uncontrolled/unguided section 130 is unguided.

The raft 120 includes a keyed guide assembly 250 that includes a pair of spaced apart guide members 251, 255. Guide member 251, 255 includes a guide wheel 254, 258 (or other useful member) supported axially by a guide post (with 252 shown in FIG. 2B for wheel 254 and shown in later drawings for wheel 258) extending outward from the lower surface/bottom 223 of the raft 120. The wheels 254, 258 have an outer diameter, $Diam_{Wheel}$, selected to be smaller than minimum widths of slots or grooves provided in guiding subsections of the flume 110. The two guide posts (including post 252) of the keyed guide system 250 typically are provided so that their vertical axes are contained in a vertical plane that also contains the central axis, $Axis_{Center}$, of the raft 100 to provide desired orientation of the raft in such guiding subsections (e.g., such that the center of the raft follows a path defined by the slots/grooves in the guiding subsections).

To ensure that the raft 120 is free to rotate 123 and have side-to-side movement 125, the keyed guide assembly 250 is designed such that the height, $H_{Guide}$, is chosen to be less than the water depth, $d_{Flume}$, in the flume 110 when combined with the draft of the raft 120 in the water 104 under maximum expected load conditions and eccentric load conditions. This provides a clearance between the bottom portions of the wheels 254, 258 and the upward facing surface (or upper surface) 217 of the bottom wall 216 of the flume 110, which allows the raft 120 to float unimpeded by the surface 217 of the flume 110 through the uncontrolled section 130 of the flume 110 (or system ride path). Further, the section 130 of the flume 110 is free of any tracks, grooves, or slots that would contact the wheels 254, 258 or upon which they may roll so that the raft 120 is not guided or oriented at all by the keyed guide assembly in the uncontrolled section 130 (with bumper 128 and sidewalls 112, 114 of the flume 110 providing the only guidance).

The combination of the keyed guide assembly 250 on the raft 120 and a flume bottom surface geometry configured to provide a track (e.g., as may be defined by sidewalls of a groove or slot in a raised portion of the bottom sidewall of the flume 110) provides a water ride system with both an uncontrolled or dynamic portion of the ride path and a boat-guiding configuration for other portions of the ride path. Stated differently, when a ride system is designed to present a show that would benefit from a more directed ride experience, the guiding can be changed from the inflatable rubber bumper contacting flume sidewalls to having the keyed guide assembly interacting with the bottom or lower wall of the flume configured with a geometry to define a boat orientation (e.g., limit rotation) and a length of the ride path (e.g., the horizontal location of the boat within the flume such as in the center of the flume or closer to one or the other of the two sidewalls defining the flume). This can be achieved without any moving or motorized/actuated parts by funneling the boat using the force of the flowing water into and out of the guiding groove/slot or track of the controlled or guided section of the flume.

FIGS. 3A-3C are schematic top, end, and side views, respectively, of the water ride system 100 showing further details of the keyed guide assembly 250 and of guiding subsection 332 of a controlled or guided section (labeled 430 in FIG. 4) of the ride's flume 110. As can be seen from these figures, the keyed guide assembly 250 includes a pair of spaced apart guide members 251, 255 that include guide posts/axles 252, 356 pivotally supporting a guide wheel 254, 258 (e.g., a hard rubber or plastic tire on a metal rim or the like chosen for durability in the water-based operating conditions).

The guiding subsection 332 of the flume 110 includes a portion of the bottom or lower wall of the flume 216 that is raised to provide an upper surface 317 defining a shallower depth, $d_{Flume}$, of the flume 216. A track through the subsection 332 is defined in this raised portion via a groove or slot 360 in the surface 317. The groove or slot 360 is defined by inner surfaces 363, 365 of a pair of spaced-apart sidewalls 362, 364 joined together by an upper surface 367 of a lower wall 366. The groove/slot 360 may have a rectangular cross section (e.g., square shape) as shown with each of these surfaces 363, 365, and 367 having equal dimensions, but this is not required. Note, it will be well understood by those skilled in the art that the groove/slot functionality may be provided in a number of other ways. For example, guiding rails may be used to define the track, and these rails may be mounted to the flume bottom as opposed to being a part of the flume structure itself. The guiding rails may be configured to have a feature that acts as a guide slot as shown. Steel or wood (or other useful materials for water-based use) guide rails can be mounted to the bottom of the tube guiding flume that create a slot for the guide wheels while keeping the simple square flume geometry.

The depth of the slot or groove is chosen to provide a depth of water 104 that is great enough that the guide members 252, 255 do not contact the bottom surface 367 even when the flume is at a lowest expected fill and the raft is at a maximum expected draft (considering load and/or fill of bumper 128). The depth of the water 104 in the flume 110 is chosen in combination with the length of the guide posts 252, 254 to make sure the wheels 254, 258 enter into the slot/groove 360 so that the wheels 254, 258 will roll upon the surfaces 363, 365 (and do not float over the groove/slot 360 when in the guiding subsection 332).

Further, the width of the slot/groove 360 (as measured as the distance between surfaces 363, 365 of sidewalls 362, 364) is chosen to be greater than the outer diameter, $Diam_{Wheel}$, of the wheels 254, 258. In some embodiments, there is a clearance (or difference in dimensions) provided of 1 to 8 inches or more (e.g., with a wheel diameter being 10 to 50 percent of the slot/groove width) to ensure the wheels 254, 258 can be received within the slot/groove 360, without being so large as to allow rotation of the raft 120 when two guide members 251, 255 are utilized (e.g., the width of the slot/groove 360 is less than about an entire length of the keyed guide assembly 250 as measured from an outermost surface of the two wheels 254, 258 in the embodiment of FIGS. 3A-3C).

In this way, the orientation of the raft 120 is set by the groove/slot 360 to one of two orientations depending upon which guide member 251, 255 enters the groove/slot 360 first upon entering the guiding subsection 332. In other embodiments (not shown), a single guide member (251 or 255) is provided, such as with the guide post vertical axis coinciding with the raft center axis, to guide the raft 120 through the subsection 332 (along the track/ride path defined by the groove/slot 360) but to allow the raft to rotate 123. The guide member and/or slot/groove (or track member) may have differing configurations to practice the system 100. For example, a guide post without a wheel could be used. The groove cross section could be chosen to receive the wheels and limit vertical travel (whereas in the illustrated system 100 vertical bobbing motion is allowed).

Figure 4:
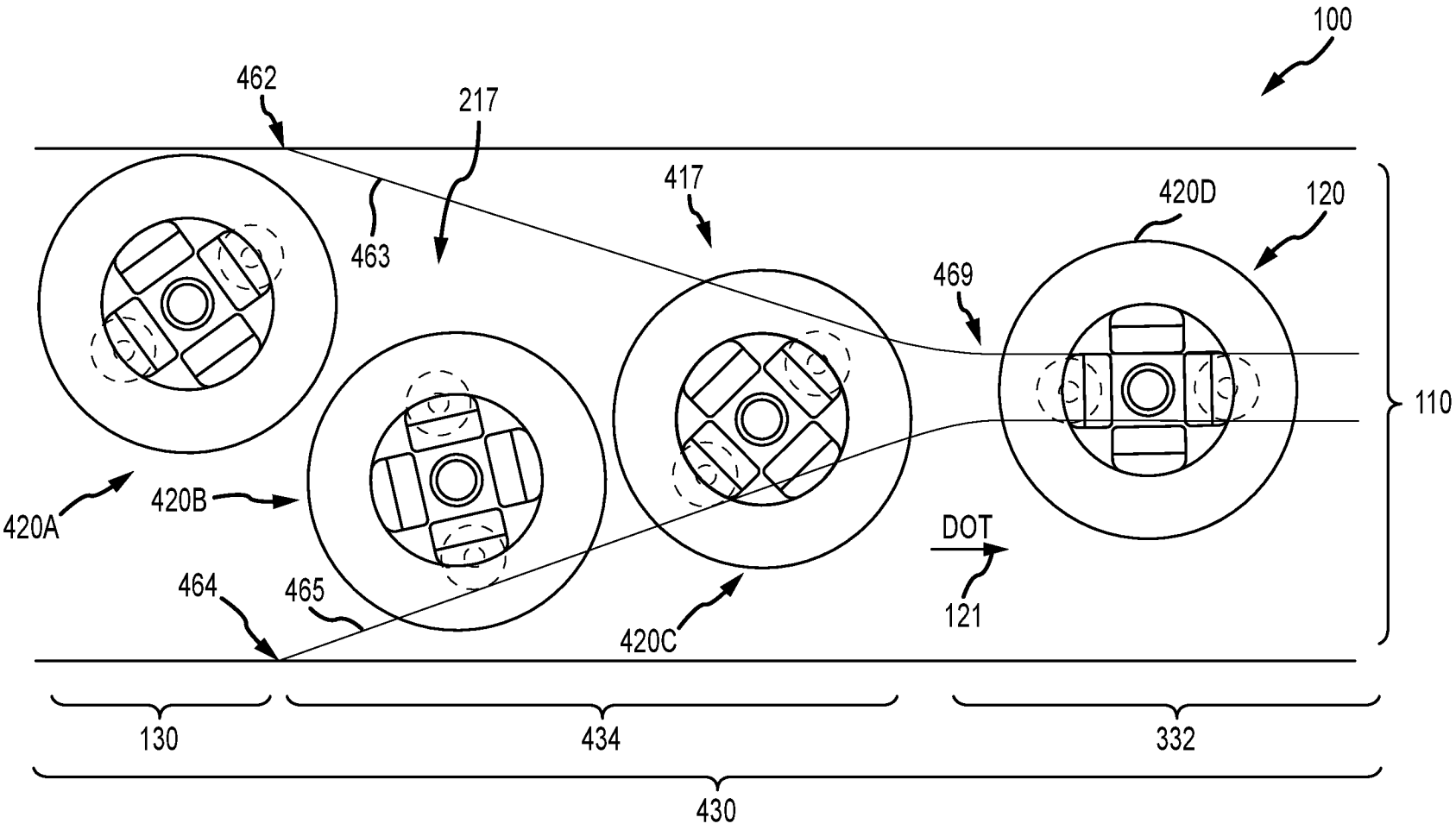
FIG. 4 illustrates a schematic top view of the water ride system of FIGS. 1-3C showing rafts being redirected or funneled into the guiding subsection via a capturing or receiving subsection of the controlled or guided section of the ride's flume.

There are a number of ways in which the raft 120 may be directed into (and back out of) the guiding subsection 332. FIG. 4 illustrates a schematic top view of the water ride system 100 showing raft 120 traveling along the DOT shown by arrow 121 in the flume 110 with its orientation set and retained by the interaction between the guide assembly 250 and the slot/groove 360 in the bottom wall 366 of the flume 110. The raft 120 is also unable to rotate within the guiding subsection 332.

Further, FIG. 4 shows another raft with a configuration matching that of raft 120 at three different positions (or states) in the water ride system 100 as shown at 420A, 420B, 420C, and 420D as it is being redirected or funneled into the guiding subsection 332 via a capturing or receiving subsection 434 of the controlled or guided section 430 of the ride's flume 110. System 100 uses a change in flume geometry (as shown in FIG. 4) to cause a raft with a guide assembly 250 to be transitioned from an unguided (or bumper guided) section 130 into the guiding subsection 332 of the guided/controlled section 430 without any moving parts by funneling the raft 420A-420C into the keyed guided subsection 332 using the force of the flowing water 104 in the flume 110.

As shown, the flume 110 includes a receiving or inlet subsection 434 upstream of the guiding subsection 332 in the guided/controlled section 430 to provide such raft "funneling" or redirecting of its travel to cause it to enter an inlet 469 of the slot/groove 360. The inlet subsection 434 includes a raised portion in the flume's bottom wall 216 (similar in height as in the subsection 332) that sets a shallower depth of the water 104 to avoid the guide members 251, 255 floating over the subsection 434. Again, it should be noted that guiding rails may be utilized to provide or replace the use of flume structural features. A pair of sidewalls 462, 464 are provided with inner or contact surfaces 463, 465 that are angled inward from the inlet of the inlet subsection 434 to the inlet or opening 469 of the guiding subsection 332 and/or the track-defining groove/slot 360. The top edge of the sidewalls 462, 464 may be provided at a similar depth as that of the slot sidewalls 362, 364 to provide a similar depth of water 104 and to ensure the wheels 254, 258 of the guide members 251, 255 contact the surfaces 463, 465 when the raft travels near the outer edges of the flume 110. The slope or inward angle of the sidewalls 462, 464 (which are typically vertical in the flume 110) is chosen to obtain a desired quickness of the funneling or capturing effect, with a range of 15 to 45 degrees or more being desirable in some cases (and with an angle of about 30 degrees shown in FIG. 4).

As shown in FIG. 4, a raft 420A is initially free to rotate and move side-to-side in an unguided (or bumper guided) section 130 of the flume 110 as it flows with the moving water 104 in the DOT as shown with arrow 121. After the raft 420B with a guide assembly 250 (mounted on its lower surface) moves into the inlet subsection 434 of the guided section 430, it is guided to travel toward the location of the slot/groove inlet 460 as one of the wheels 254 or 258 strikes one of the two inner surfaces 463, 465 of the sidewalls. The wheel typically rotates some amount during such contact to limit binding and such that the guiding control often will not be felt by raft passengers. The contact will also cause the raft 420B to rotate toward an orientation required for entry into the slot/groove 360 (e.g., such that the two guide members are aligned more with the central axis of the slot/groove 360).

The width of the funnel-shaped groove or track provided in subsection 434 continues to shrink along the length of the subsection 434 such that the raft, as shown at 420C, likely will strike the sidewall surface 463 or 465 again (and again in some cases) until the raft 420C is rotated to the proper orientation (one of two possible orientations in this example) so that the two wheel 254, 258 of the guide members 251, 255 can enter the inlet 469 of the groove/slot 360. The raft 420D then travels along the guiding subsection 332 as shown for raft 120 in FIG. 4, with its orientation retained and its location within the flume 110 set by the relative location of the slot/groove 360 to the sidewalls 112 and 114 of the flume 110. Although not shown, the guided section 430 may further include a subsection after (or at the outlet of) the guiding subsection 332 that may take the opposite geometry as that shown for subsection 434 (e.g., with an outwardly sloped or angled pair of sidewalls) to funnel the rafts out of the controlled/guided section 430.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

For example, the raft does not specifically need to have a guide post with a wheel on the bottom. It can be another guiding apparatus that serves the same purpose, and, hence, the term "guide post" is intended to be construed broadly to include nearly any support element such as a body or frame of a bogie. Similarly, the term "wheel" is intended to include nearly any rolling or rollable member, and embodiments including two, three, four, or more rolling members or wheels are considered to be included in this description.

Also, the guide systems described herein can be used in sections of the flume to make loading and unloading more efficient. With this invention, the vehicle or raft can already be aligned with the station platform for quick and easy ingress/egress instead of having to take the time to rotate the boats (e.g., with a very complex control system that is not required with the new guide system) so the ingress/egress path is facing the platform.

I claim:

1. A water ride system, comprising:

a flume for receiving and containing flowing water, wherein the flume includes first and second sidewalls spaced apart defining a width of the flume and further includes a bottom wall extending between lower edges of the first and second sidewalls;

within the flume, a non-motorized raft with a body with seats for one or more passengers and with a resilient and buoyant bumper extending about a periphery of the body, wherein the raft is propelled by the flowing water in a direction of travel (DOT) coinciding with a direction of flow of the flowing water; and a guide assembly mounted on a lower surface of the body of the raft, wherein the guide assembly is at least partially submerged in the flowing water, wherein the flume includes a first section in which the guide assembly floats above an upper surface of the bottom wall as the raft travels in the DOT with the flowing water such that the guide assembly is free of contact with the flume in the first section, the raft, in the first section, being free to rotate about a central axis and to move side-to-side until the bumper contacts inward surfaces of the first and second sidewalls of the flume, and wherein the flume includes a second section including a groove in a raised portion of the upper surface of the bottom wall or including track guide rails on or toward the bottom wall, the guide assembly being at least partially received within the groove or track guide rails as the raft travels in the DOT with the flowing water in the second section, whereby the raft has side-to-side movement in the flume that is restricted by the groove sidewalls to define a ride path for the raft in the second section defined by the groove or track guide rails.

2. The water ride system of claim 1, wherein the guide assembly comprises a guide post extending outward a distance from the lower surface of the raft.

3. The water ride system of claim 2, wherein the guide assembly further comprises a wheel pivotally supported upon an end of the guide post distal to the lower surface of the raft.

4. The water ride system of claim 2, wherein the guide assembly further comprises a second guide post extending outward from the lower surface of the raft and wherein the second guide post is spaced apart a distance from the guide post, whereby the raft is limited in rotation about the center axis by inner surfaces of sidewalls defining the groove or by the track guide rails.

5. The water ride system of claim 4, wherein the guide assembly further includes first and second wheels pivotally supported upon an end of one of the guide post and second guide post distal to the lower surface of the raft.

6. The water ride system of claim 5, wherein the first and second wheels have an outer diameter that is less than a distance between the inner surfaces of the sidewalls of the groove or the track guide rails by an amount in the range of 1 to 8 inches.

7. The water ride system of claim 4, wherein vertical axes of the guide post and the second guide post are co-planar with the center axis of the raft.

8. The water ride system of claim 1, wherein the flume further includes a third section, between the first and second sections, comprising spaced apart sidewalls with inner surfaces for abutting at least a portion of the guide assembly during travel of the raft in the DOT with the flowing water in the third section and wherein the spaced apart sidewalls of the third section angle inward from the first and second sidewalls of the first section to an inlet of the groove or the track guide rails, whereby the raft is guided in the flume to move at least a portion of the guide assembly into the groove or the track guide rails of the second section.

9. The water ride system of claim 8, wherein the spaced apart sidewalls have an upper edge that is raised above the upper surface of the bottom wall, whereby, when the raft moves side-to-side in the third section of the flume, the bumper is able to float over the inner surfaces of the spaced apart sidewalls and the guide assembly at least partially contacts the inner surfaces of the spaced apart sidewalls to guide the raft within the flume.

10. The water ride system of claim 8, wherein the spaced apart sidewalls are angled inward at an angle in the range of 15 to 45 degrees.

11. A water ride system, comprising:

a flume containing flowing water;

within the flume, a raft traveling in a direction of travel (DOT) coinciding with a direction of movement of the flowing water in the flume, wherein the raft is non-motorized and is propelled in the flume by the flowing water; and a guide assembly mounted on a lower surface of the raft, wherein the flume includes a first section in which the raft responds to external forces from the flowing water to rotate about a central axis and to have side-to-side movements restrained by contact between portions of the raft, spaced apart from the lower surface and the guide assembly, and sidewalls of the flume, and wherein the flume includes a second section including a slot for receiving at least a portion of the guide assembly when the raft travels in the DOT with the flowing water in the second section, whereby the raft has the side-to-side movements in the flume that are restricted by a configuration of the slot in the second section of the flume and wherein the slot does not extend into the first section of the flume whereby the raft is unguided by the guide assembly in the first section of the flume.

12. The water ride system of claim 11, wherein the guide assembly comprises first and second guide posts extending outward from the lower surface of the raft and wherein the second guide post is spaced apart a distance from the first guide post, whereby the raft is limited in rotation about the center axis by inner surfaces of sidewalls defining the groove.

13. The water ride system of claim 12, wherein the guide assembly further includes first and second wheels pivotally supported upon an end of one of the first and second guide posts.

14. The water ride system of claim 13, wherein the first and second wheels have an outer diameter that is less than a distance between the inner surfaces of the sidewalls of the groove by an amount in the range of 1 to 8 inches.

15. The water ride system of claim 12, wherein vertical axes of the first and second guide posts are co-planar with the center axis of the raft.

16. The water ride system of claim 11, wherein the flume further includes a third section, between the first and second sections, comprising spaced apart sidewalls with inner surfaces for abutting at least a portion of the guide assembly during travel of the raft in the DOT with the flowing water in the third section and wherein the spaced apart sidewalls of the third section angle inward from the sidewalls of the flume to an inlet of the slot.

17. The water ride system of claim 16, wherein the spaced apart sidewalls have an upper edge that is raised above an upper surface of a bottom of the flume, whereby, when the raft moves side-to-side in the third section of the flume, portions of the raft are able to float over the inner surfaces of the spaced apart sidewalls and the guide assembly at least partially contacts the inner surfaces of the spaced apart sidewalls to guide the raft within the flume.

18. A water ride system, comprising:

a flume for receiving and containing flowing water, wherein the flume includes first and second sidewalls and a bottom wall extending between lower edges of the first and second sidewalls;

within the flume, a raft with a body and with a bumper extending about a periphery of the body, wherein the raft is non-motorized and travels in the flume with the flowing water;

first and second support members extending outward from the lower surface of the raft wherein the second support member is spaced apart a distance from the first support member;

first and second contact members pivotally supported, respectively, upon an end of the first and second support members, wherein the flume includes a first section in which the guide assembly floats above an upper surface of the bottom wall as the raft travels with the flowing water, the raft, in the first section, being free to move side-to-side until the bumper contacts inward surfaces of the first and second sidewalls of the flume while the guide assembly remains spaced apart from the flume in the first section, and wherein the flume includes a second section including a groove in the upper surface of the bottom wall, the first and second contact members being received within the groove as the raft travels with the flowing water in the second section, whereby the raft has side-to-side movement and rotation that is restricted in the second section.

19. The water ride system of claim 18, wherein vertical axes of the first and second support members are co-planar with the center axis of the raft.

20. The water ride system of claim 18, wherein the flume further includes a third section, between the first and second sections, comprising spaced apart sidewalls with inner surfaces for abutting at least a portion of the guide assembly during travel of the raft in the DOT with the flowing water in the third section and wherein the spaced apart sidewalls of the third section angle inward from the first and second sidewalls of the first section to an inlet of the groove, whereby the raft is guided in the flume to move at least a portion of the guide assembly into the groove of the second section.

* * * * *